United States Patent [19]

Riecker

[11] 4,069,108

[45] Jan. 17, 1978

[54] APPARATUS FOR REMOVING DUST-CONTAINING GASES DURING COKING OPERATIONS

[75] Inventor: Johann Georg Riecker, Ratingen, Germany

[73] Assignee: Hartung, Kuhn & Co. Maschinenfabrik GmbH, Dusseldorf, Germany

[21] Appl. No.: 669,825

[22] Filed: Mar. 24, 1976

[30] Foreign Application Priority Data

Mar. 26, 1975 Germany ..... 2513449
July 22, 1975 Germany ..... 2532770

[51] Int. Cl.[2] ..... C10B 27/00; C10B 27/04
[52] U.S. Cl. ..... 202/263
[58] Field of Search ..... 202/263, 254, 260; 432/72

[56] References Cited

U.S. PATENT DOCUMENTS

| | | | |
|---|---|---|---|
| 3,522,017 | 7/1970 | Barfield, Jr. | 23/284 X |
| 3,729,384 | 4/1973 | Kinzler et al. | 202/263 |
| 3,868,309 | 2/1975 | Sustarsic et al. | 202/263 X |
| 3,895,918 | 7/1975 | Mueller | 23/277 C |
| 3,923,464 | 12/1975 | Sitek et al. | 23/292 X |
| 3,972,780 | 8/1976 | Calderon | 202/263 X |

FOREIGN PATENT DOCUMENTS

| | | | |
|---|---|---|---|
| 2,326,630 | 12/1974 | Germany | 202/263 |

*Primary Examiner*—Morris O. Wolk
*Assistant Examiner*—Arnold Turk
*Attorney, Agent, or Firm*—Michael J. Striker

[57] ABSTRACT

A gas-collecting arrangement movable from one coking chamber to the next and serving to remove exhaust gases emitted during pushing and/or quenching of coke and during filling of coking chambers with coal, includes a shielding device arranged within the collecting main at a distance from a flexible belt and extending at least across the intake cross-section of the collecting main to separate the gas stream in the main from the flexible belt.

13 Claims, 16 Drawing Figures

VI
VI
2
2
2
10
11
12
13
14
15
16
17
18
19
19
21
21
22
33
3
3
5
5
7
9
9
-1-

Fig.12
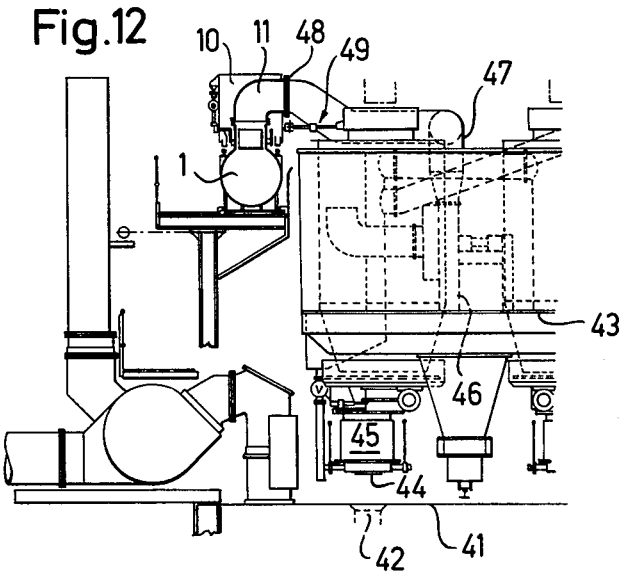
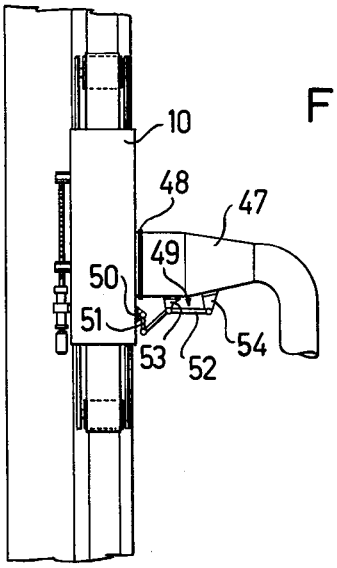
Fig.13

APPARATUS FOR REMOVING DUST-CONTAINING GASES DURING COKING OPERATIONS

FIELD OF THE INVENTION

The invention relates to apparatus for removing gases containing dust and other particulate matter evolving from the operation of a coke oven battery by means of a gas collecting arrangement movable from one coking chamber to the next, said arrangement being connected to a removal duct having a stationary collecting main for removing the gases positioned essentially parallel to the path of movement of said gas collecting arrangement, said main being provided at its top side with a full-length slotted longitudinal opening that can be covered by at least one flexible belt and with an enveloping carriage connected to the removal duct and movable parallel to said longitudinal opening, and the carriage being provided with guide rollers for lifting the flexible belt from the collecting main within the outlet region of the removal duct.

DESCRIPTION OF THE PRIOR ART

U.S. Pat. No. 3,729,384 (German OS No. 2,201,963) teaches removing dust-containing gases emitted during pushing coke from coking ovens, by providing a gas-collecting main along the coking side of the coke oven battery, its open top side being covered by a flexible belt made of a heat-resistant material. Arranged on the gas collecting main is a hood jointly movable with the coke guide, said hood having an intake port or a supply line for the dust-containing gases. Rollers are provided inside of the hood for lifting the flexible belt to provide an opening in the gas-collecting main. The flexible belt is thus directly acted upon by the hot exhaust gases that are laterally sucked into the hood. Accordingly, the belt must be manufactured of a heat-resistant material which, in addition, must be wear-resistant. Heat-resistant, wear-resistant belts with a life span of several years necessary for coking operations, which furthermore have the flexibility necessary for this application, are however not available.

A device of the type mentioned at the beginning for removing dust-containing gases emitted during pushing and/or quenching coke from coking chambers, is taught by German OS No. 2,326,630, which provides a cooling device constructed as a bundle of pipes between the dust collecting hood and the connecting carriage for connecting the removal duct with the collecting main. This indeed enables a certain amount of precooling of the hot exhaust gases prior to entry into the collecting main; nevertheless, it requires a heat exchanger of relatively high weight, so that the mobile exhaust device becomes quite heavy. The additional weight of the heat exchanger increases the wheel loads of the machines so that they become inadmissibly high for the majority of existing coke oven batteries, so that expensive reenforcements of foundations and supporting structures become necessary. In the case of newly constructed coke oven batteries, the high weight of the cooling apparatus requires a correspondingly heavy and thus expensive support structure for the driving gear of the machines provided with this device. Furthermore, practice has proven that, particularly when pushing unfinished coking chambers, cooling apparatus consisting of a plurality of pipes becomes coated with a sticky layer due to the condensation of tar mist and other gaseous components of the plunging coke. This drastically reduces the heat exchange between the hot gases and the cooling apparatus, which can result in a destruction of the flexible covering belt. In order to nevertheless enable an exchange of heat to occur, it is necessary to clean the individual pipes (often several hundred of them) at frequent intervals. Maintenance requiring such extensive work, of necessity, places narrow limits on the practical application of such a cooling apparatus to coking plants.

Gases containing dust and particulate matter nevertheless develop not only during pushing and/or quenching of coke from coking chambers, but also in the course of filling the coking chambers with coal. A number of experiments have also been undertaken in this area, in order to achieve an effective removal of the gases that would require practically no maintenance.

It is the object of the invention generally to provide an apparatus of the above-mentioned type in which the action of heat from the hot exhaust gases conveyed through the collecting main onto the flexible covering belt is reduced by simple means to a value permitting the use of a presently commercially available wear-resistant material that is not highly heat-resistant.

SUMMARY OF THE INVENTION

The invention obviates the above-described difficulties by providing a protective device arranged within the collecting main at a distance from the flexible belt and extending at least across the intake cross-section of the collecting main to separate the gas stream in the collecting main from the flexible belt.

According to one embodiment of the invention, cooling tubes are arranged between the flexible belt and the protective device, extending perpendicular to the collecting main, whereby the cooling tubes have blowing outlets for cooling air pointed in the direction of flow of the gases toward the belt.

In that connection it is helpful to have the protective device consist of guide plates or blades arranged along the collecting main at essentially equal distances from each other.

Placing this protective device between the flexible belt and the actual gas-collecting main causes the bottom surface of the flexible belt to be protected from the heat transported in the direction of the belt by the compulsory and also the free convection currents, as well as from the heat radiated by the hot exhaust gases, so that the temperature of the belt can be maintained below that maximum surface temperature permissible for commercially available, non-heat-resistant belts. Thermal shielding is favored by the formation of eddy currents of cooling air emerging from the above-mentioned cooling tubes between the individual guide plates to that heat transfer between the hot exhaust gases and the bottom surface of the belt is prevented. Such protective device renders possible drawing of a stream of exhaust gases at a temperature of ca. 600° C through the gas-collecting main without raising the temperature of the bottom surface of the flexible covering belt to above 150° C. The combination of cooling tubes and guide plates has the advantage that the region close to the belt is acted upon by the cooling air, thereby forming a flowing protective film, so to speak, against the hot gases. In addition, the gas-collecting main as well as the guide plates act throughout the entire length of the exhaust conduit during the relatively short coke pushing operation as a heat reservoir that is cooled during the longer intervals between the individual coke pushing operations by the cold surrounding air flowing through the gas-collecting main.

The effect of the formation of eddy currents between the individual guide plates, or blades, as well as shielding the bottom surface of the flexible belt against heat rays, however, is best achieved if the projection of end guide plate in the intake direction of the gases is the same or greater than half of the distance between two guide plates.

The guide plates may be stationary, nevertheless they may also be mounted on shafts perpendicular to the direction of flow of the gases, said shafts being parallel and movable. In the latter case, it is helpful to have at least one end of each shaft of each guide plate protruding from the collecting main and each connected with an adjustable lever engaging an adjustable crosstie of the enveloping carriage arranged parallel to the collecting main, the crosstie being connected to the enveloping carriage for movement between an operative and an inoperative position by means of a control device. The guide plates or blades over which the air streams, may have a concave surface.

Nevertheless, the guide plates may also be constructed with a support surface profile. Such profiles are suitably hollow so that they can be connected to ventilation means.

For one specific embodiment of the invention, the connecting line between the rollers lifting the belt is inclined against the direction of flow of the gases, and the cooling tubes are arranged along the inner side of the belt within the area of the just-lifted belt, such tubes being provided with the blowing openings for cooling air directed against the belt. This embodiment has an asymmetrically constructed enveloping carriage. Such arrangement provides for a particularly large supply of cooling air at that location at which the covering belt might come in contact with the hot gases.

At the location at which the hot gases are supplied to the collecting main where the flexible belt is lifted up by means of the enveloping carriage, the cooling air emitted from the cooling tubes mixes with the supplied hot gases so that the temperature of the gas mixture flowing in the collecting main is already reduced.

Accordingly, it is apparent that in the closed position of the overlapping guide plates the cooling tubes are positioned within the area formed by the side walls of the collecting main, the protective wall formed by the guide plates, and the flexible belt, so that the air ejected from the cooling tubes flows between the protective wall and the flexible belt. Thus, thw flexible belt is separated from the hot gases over the entire length of the exhaust conduit, so that here also the use of commercially available, wear-resistant non-heat-resistant rubber belts would be possible to cover the gas-collecting main, without having to fear excessive and thus endangering heating of the belts. In general, the pressure prevalent in the exhaust conduit is a reduced pressure compared with that of the environment. This means that the cooling air is automatically sucked from the outside into the cooling tubes. Nevertheless, it is also possible to connect the cooling tubes to conduits for the supply and removal of cooling air, such conduits being located outside of the gas-collecting main; this will ensure the necessary air supply.

The apparatus of the present invention may be used to remove the dust-containing gases emitted during pushing and/or quenching of coke from coking chambers. In that instance it is helpful to have the removal duct of the enveloping carriage connected with a mobile collecting arrangement for the dust-containing gases or vapors accumulating on the coking side of the furnace.

The apparatus of the present invention is just as effective in removing gases containing dust or particulate matter evolving during the filling of coking chambers with coal. In that case it is useful to have the removal ducts of the enveloping carriage connected with a movable collecting arrangement for the dust or particulate matter — containing gases or vapors accumulating during the filling of a coking chamber.

DESCRIPTION OF THE DRAWINGS

The description refers to the accompanying drawings in which like reference characters refer to like parts throughout the several views, and in which:

FIG. 12 is a cross-section similar to that of FIG. 11 showing another connection between the connecting duct of the enveloping carriage and the charging gas collecting conduit of a charging car.

FIG. 13 is a plan view of the enveloping carriage with the charging gas collecting conduit of FIG. 12, omitting the remaining parts;

DESCRIPTION OF THE PREFERRED EMBODIMENTS

Figure 1:
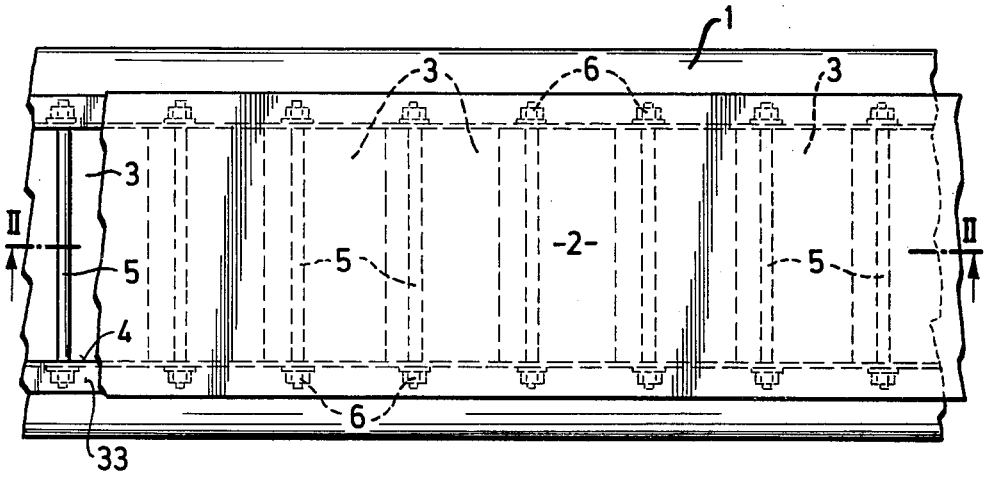
FIG. 1 is a plan view of one part of a gas-collecting main covered by a flexible belt.
Figure 2:
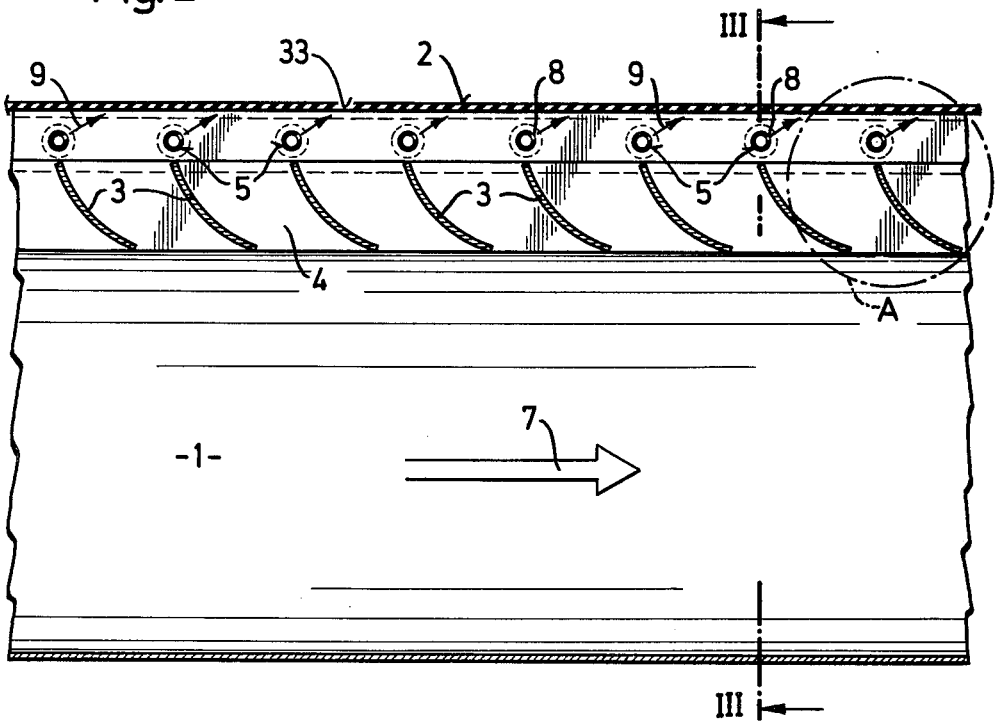
FIG. 2 is a cross-section along the line II—II of FIG. 3, respectively of FIG. 1.
Figure 3:
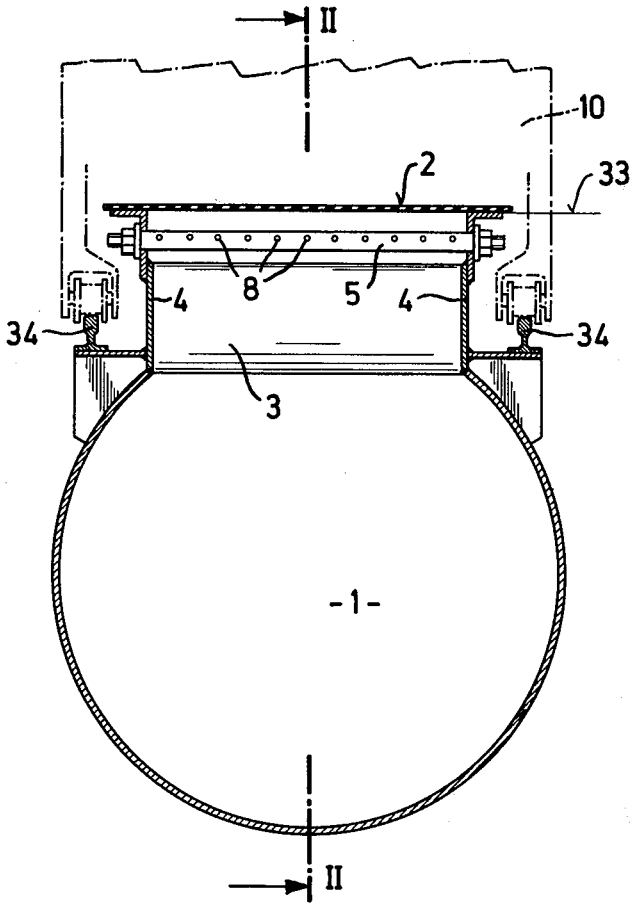
FIG. 3 is a cross-section along the line III—III of FIG. 2.
Figure 4:
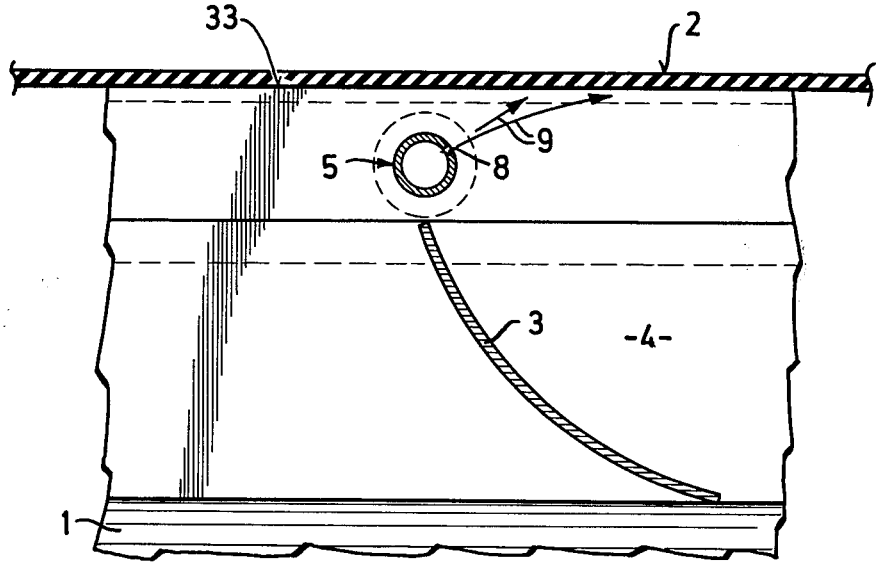
FIG. 4 is an enlargement of the area A of FIG. 2.

Referring now to the drawings, the invention is described with reference to customary apparatus for removing gases containing dust and other particulate matter emitted during the operation of a coke oven battery.

FIGS. 1–4 show that a collecting main 1 has a circular cross-section, whereby one section has been cut out lengthwise and a conduit extension 4 consisting of parallel walls is welded to the longitudinal cut surfaces of the remaining circular segment, said extension ending in horizontal flanges 33 on top of which a flexible belt 2 rests. Shown by dotted lines in FIG. 13 is an enveloping carriage 10 with a removal duct, said carriage running on tracks 34 mounted laterally to the collecting main 1.

Guide blades or plates 3 are provided as a protective device directly beneath the flexible belt 2 covering the collecting main 1, said blades 3 being positioned at equal distances from each other and having a convex shape with respect to the direction of flow of the gases as indicated by the arrow 7. This curvature of the blade causes the gases flowing into the collecting main 1 to be diverted away from the underside of the flexible belt 2. The example illustrated shows that the ratio of the projection of one guide blade in the direction of flow to the distance between two guide blades is very high.

One cooling tube 5 is positioned respectively between each end of the guide blade 3 associated with the flexible belt 2 and the bottom surface of said flexible belt 2, said tube having blowing outlets 8 which may be slots, for example, and which point slightly upwards toward the belt 2 in the direction of flow of the gases. Cooling air is blown through these blowing outlets 8 in the direction of the arrow 9 against the bottom surface of the flexible belt 2. As apparent from FIG. 1, the ends 6 of said cooling tubes 5 are placed outside of the collecting main 1. The cooling tubes 5 are self-priming due to the reduced pressure within the collecting main 1.

Figure 5:
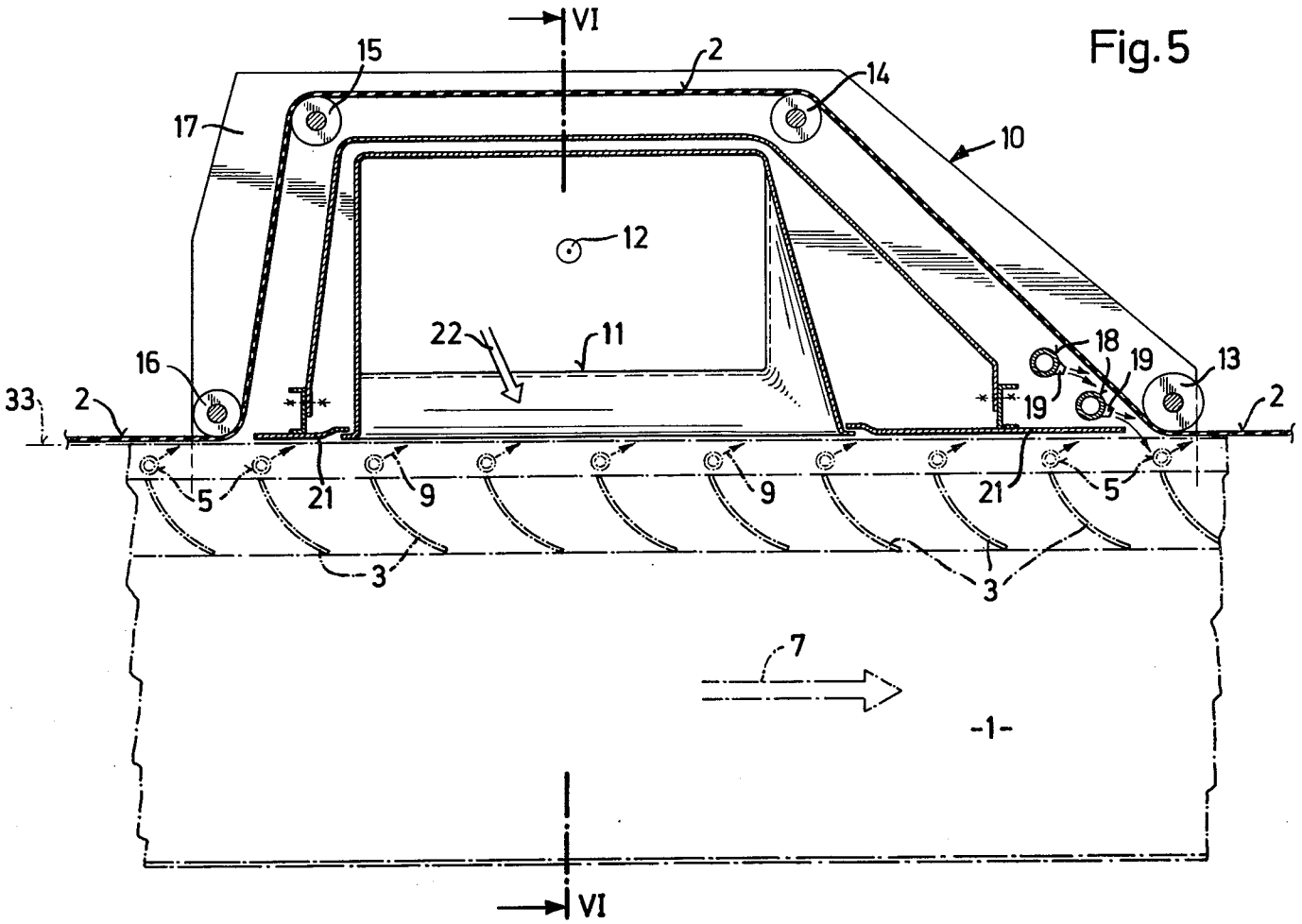
FIG. 5 is a cross-section along the line V—V of FIG. 6 showing a section of the collecting main at which the enveloping carriage with the removal duct for the gas supply is located.
Figure 6:
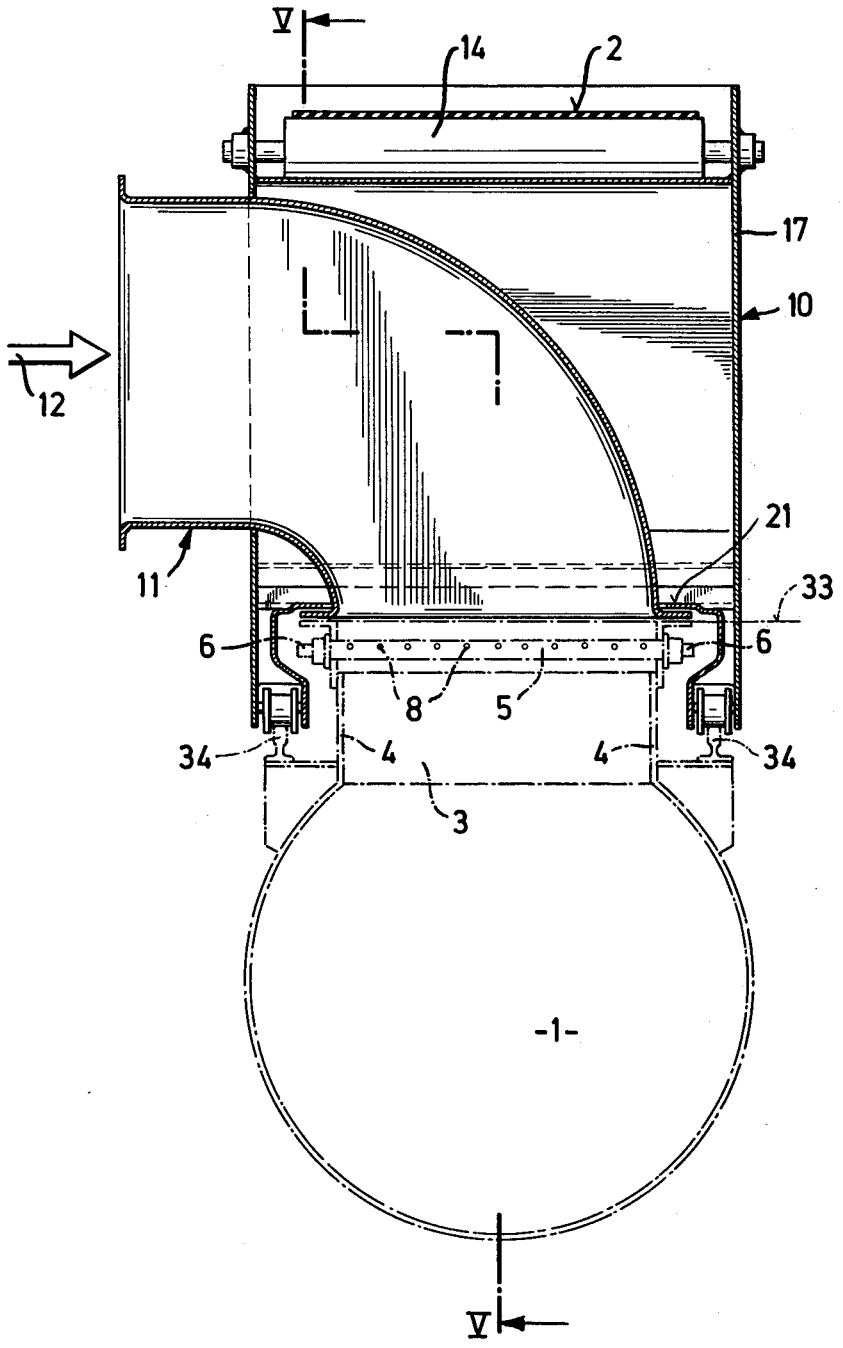
FIG. 6 is a cross-section along the line VI—VI of FIG. 5.

FIGS. 5 and 6 show that location of the collecting main 1 at which a removal duct 11 with the enveloping carriage 10 is located. The enveloping carriage 10 has a front roller 13 pivoted on a frame 17, said roller 13 pressing the flexible belt 2 against the top surface 30 of the collecting main 1. By means of a front top roller 14 placed in staggered relation against the direction of flow and in upward direction with regard to the front roller 13, belt 2 is directed upward, whereby the angle of inclination of the belt to the horizontal plane is smaller than 60°. The flexible belt 2 is directed around the removal duct 11 over the front top roller 14 and a back top roller 15, and then steeply downward to a back roller 16, which then presses the flexible belt 2 again against the top surface 33 of the collecting main 1. As concerns its rollers 13–16, the enveloping carriage 10 is constructed asymmetrically in the direction of the gases emerging from the removal duct 11, as shown in FIG. 6 by the arrow 12. The gases emerging from the removal duct 11 then proceed in the direction of an arrow 22 into the collecting main 1, and the sections between the port of the removal duct 11 and those locations at which the flexible belt 2 is lifted away from the collecting main 1, are covered by guards 21. The gases are directed into the interior of the collecting main 1 to flow in the direction 7, by means of guide blades or scoops 3. By means of the cooling air ejected from the cooling tubes in the direction of the arrows 9, simultaneous mixing of the hot gas intake and the cooling air occurs, so that the temperature of the gases conveyed through the collecting main 1 is being lowered due to that mixture.

FIG. 5 shows cooling tubes 18 extending between the front guard 21 and the belt 2 guided between the front roller 13 and the front top roller 14, said tubes 18 being at right angles to said belt 2 and having blowing outlets 19 inclined somewhat toward the bottom surface opposite to the direction of movement of the belt 2, whereby cooling air is blown against the belt 2 and directed through the slot between the covered belt 2 and the guard 21 toward the inside of the collecting main 1, i.e., a particularly large amount of cooling air is provided at that location at which the belt 2 would come in contact with the hot gases supplied by the removal duct 11.

Figure 8:
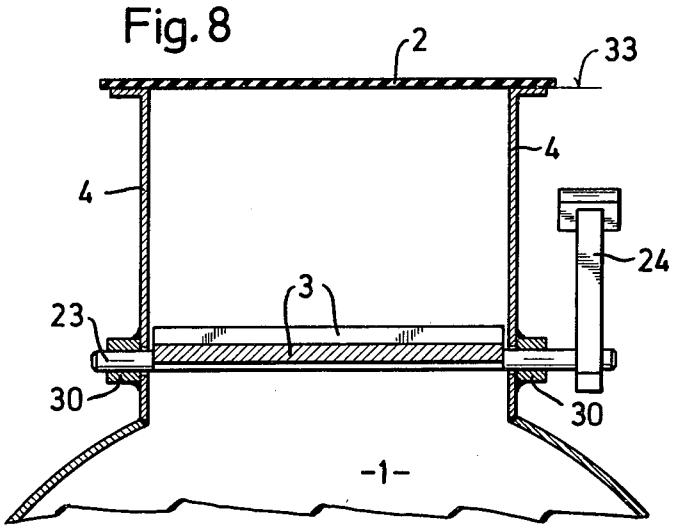
FIG. 8 is a cross-section along the line VIII—VIII of FIG. 7.
Figure 7:
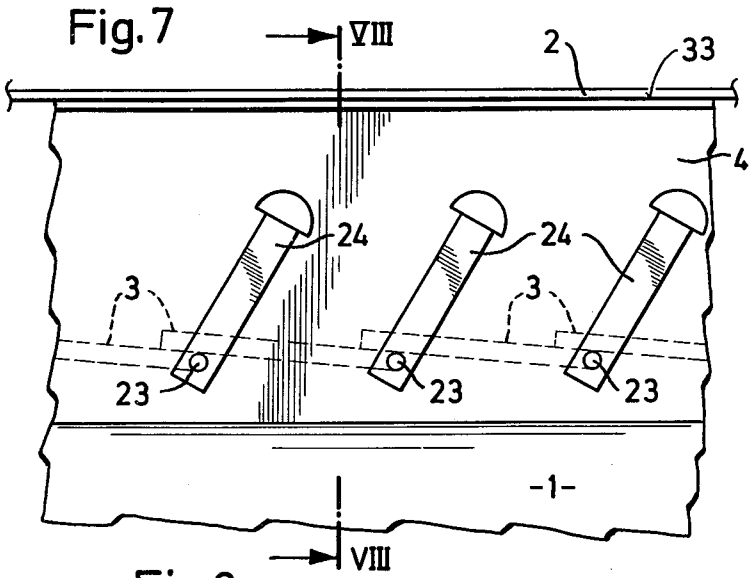
FIG. 7 is a partial view of the collecting main viewed from the side with the adjustable guide plates.
Figure 9:
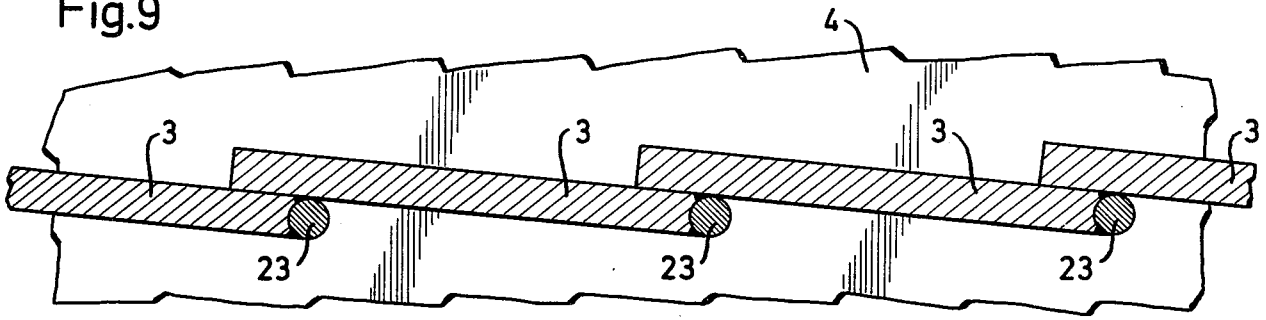
FIG. 9 is a detailed cross-section showing the overlapping guide plates in the collecting main pursuant to the embodiment shown in FIG. 7.

The embodiment shown in FIGS. 7–10 illustrates a protective device consisting of guide plates 3 connected to shafts 23. FIG. 8 shows that the shaft 23 of each guide plate 3 extends across the conduit extension 4 and is journaled in bearings 30. Operation of each shaft 23, thereby adjusting each guide plate 3, is effected by an adjustable lever 24 positioned outside of collecting main 1, said lever 24 being attached to the one end of each shaft 23. FIGS. 7 and 9 show the overlapping guide plates 3 in a closed position. When in that position, the guide plates 3 form a closed protective wall between the flexible belt 2 and the inner space of the collecting main 1. The adjustable levers 24 are fixed to the shafts 23 such that their angle with respect to the guide plates 3 is greater than 90°, i.e., in the closed position of the guide plates 3 illustrated, the adjustable levers 24 are directed diagonally upward. In the case of a spontaneous increase in pressure in the collecting main 1, for example due to a gas explosion, the guide plates 3 are automatically lifted upward so that the pressure can be equalized. It is of course possible to leave a small slot for the emergence of cooling air open also between the guide plates, in contrast to the illustration provided by FIG. 9.

Figure 10:
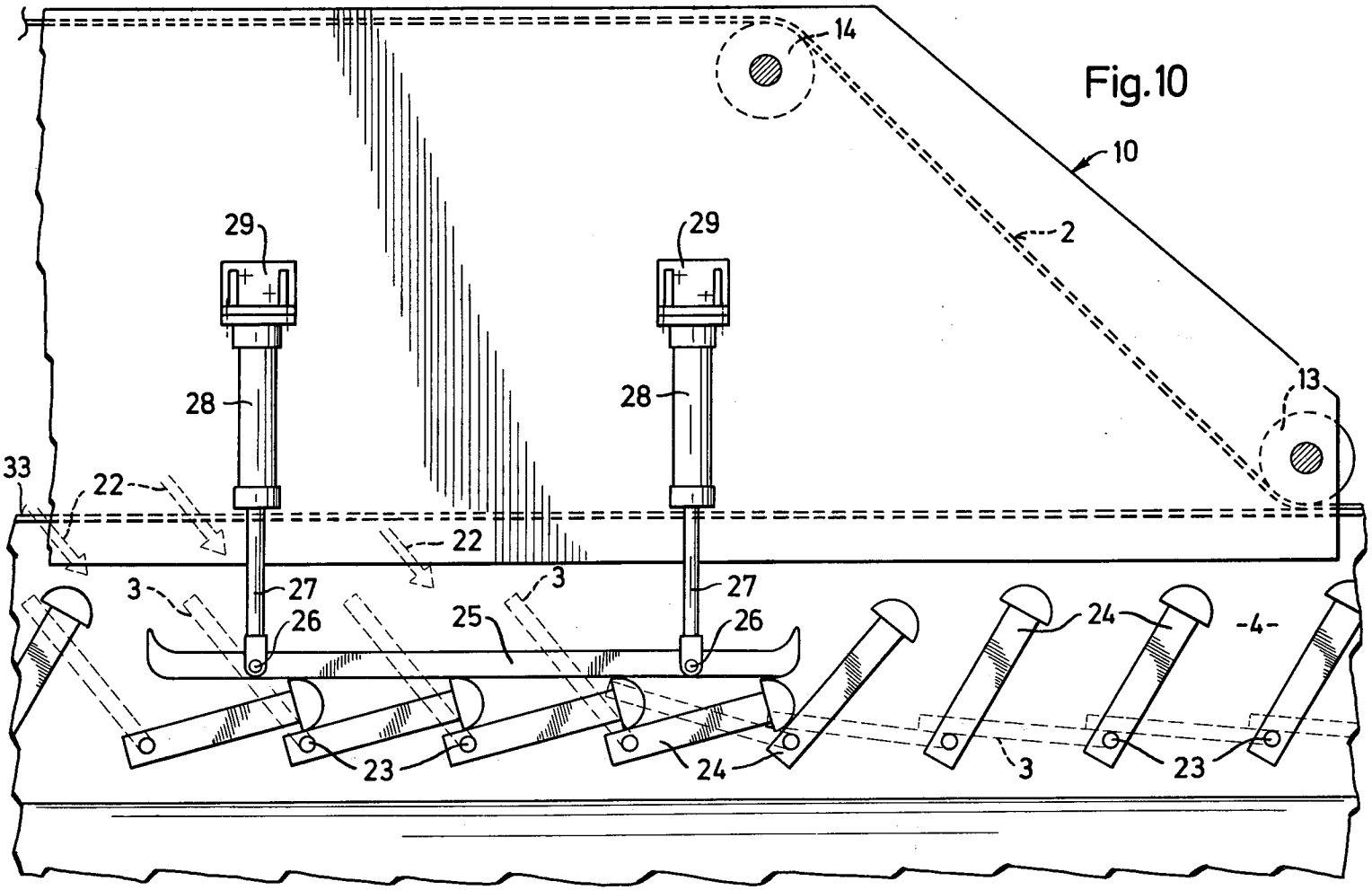
FIG. 10 is a schematic side view of the gas supply location (FIG. 5) with removed connecting duct.

FIG. 10 shows a control device together with the enveloping carriage 10 in side view.

An adjustable crosstie, respectively an adjustable sled 25 is linked to piston rods 27 of control cylinders 28 by means of lugs 26. The control cylinders 28 are attached to the outer wall of the enveloping carriage 10 by means of brackets 29. The adjustable crosstie 25 is arranged such that it is positioned above the adjustable levers 24 when it is in a raised position, so that the enveloping carriage 10 can be moved lengthwise of the gas collecting main 1 without engaging the adjustable levers 24. In the lowered position, the adjustable crosstie 25 presses the adjustable levers 24 coming within its region of contact downward, as apparent from FIG. 10, whereby the guide plates 3 pivot upward, so that the gas emerging from the connecting duct 11 can flow inside the gas collecting main 1 in the direction of the arrows 22 lengthwise of the guide plates 3. Upon raising the adjustable crosstie 25, the guide plates 3 fall back into their starting position due to the force of gravity, so that they form a continuous protective wall in that position.

In similar fashion as shown in FIGS. 7–10, it is possible to pivot support surface profiles in place of guide plates 3, whereby the axes of rotation can be arranged either transversely to the section of on-coming flow or transversely to the section of escaping flow. Nevertheless, the support surface profiles can also be employed in place of the stationary guide scoops of the embodiment shown in FIGS. 1–6.

Figure 11:
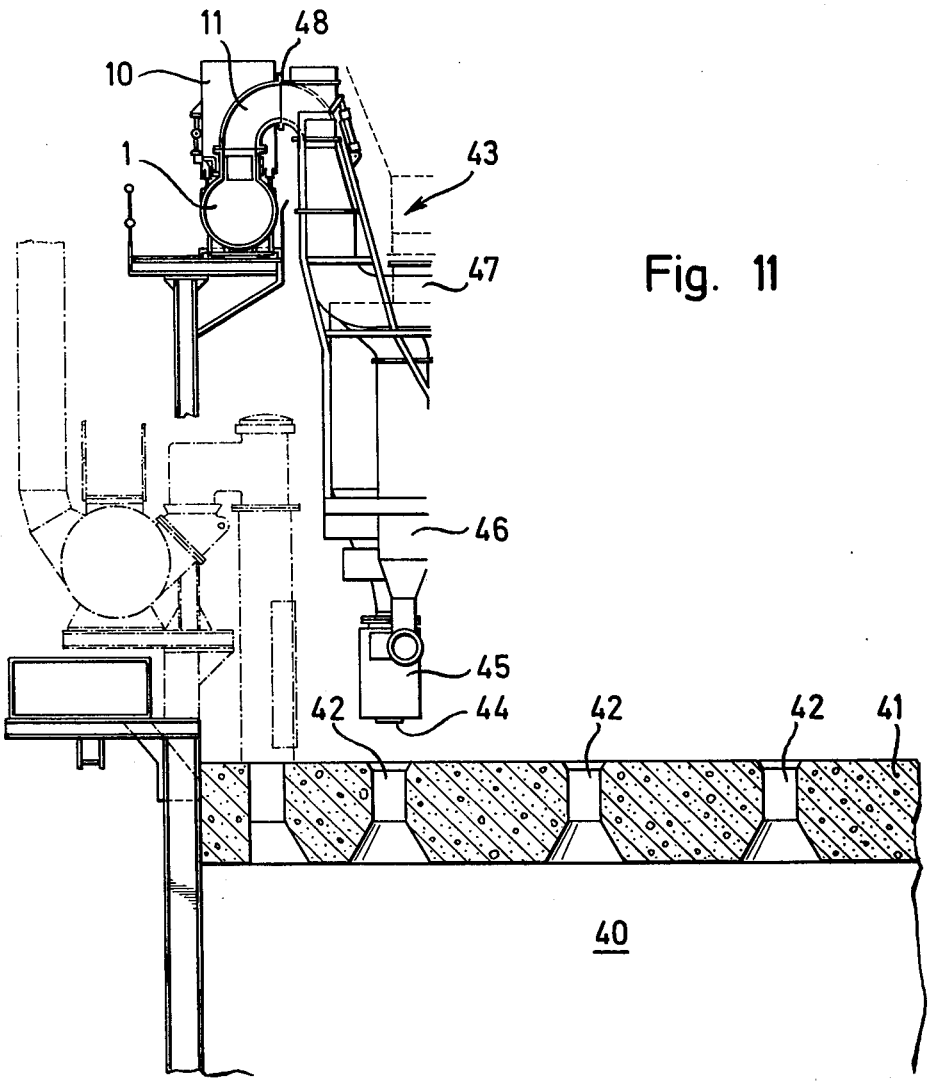
FIG. 11 is a schematic cross-section showing the connection between the connecting duct of the enveloping carriage and the charging gas collecting conduit of a charging car.

FIG. 11 shows a hopper car 43 movably arranged on the roof 41 of the coke oven battery, of which one coking chamber 40 is shown in cross-section. A coke oven roof 41 is provided with charging ports 42 with which there are associated charging ducts 44, only one of which is schematically shown in FIG. 11. Each charging duct 44 is surrounded at a radical distance by a charging gas removal hood 45, such that an annlar space exists between the charging duct 44 and the removal hood 45. When the charging duct 44 has been lowered into the charging port 42, the removal hood 45 is placed on the coke oven roof 41 such that it provides a seal. The gases emerging from the charging ports during the charging operation around the charging duct 44 pass through the annular space between said charging duct 44 and the removal hood 45 into a charging gas conduit 46 connected to a charging gas collecting conduit 47 movable in conjunction with the hopper car 43. The charging gas collecting conduit 47 is connected to the removal duct 11 of the enveloping carriage 10 by means of a flange connection 48, so that the charging gases escaping from the coking chamber 40 can be directed into the collecting main 1 as the coking chamber is being filled, without the possibility of escaping into the atmosphere.

In FIG. 12 those parts identical to those of FIG. 11 have been provided with the same reference numerals. FIG. 12 shows a clutch engaging the lower region of the enveloping carriage 10, consisting, as shown in FIG. 13, of an attachment piece 50 fixed to that lateral side of the enveloping carriage 10 which faces the hopper car, and a strap 51 hinged to said attachment piece, the free end of said strap being hinged to a carrier stem 52. The carrier stem 52 is removably connected to two attachment pieces 53, 54 affixed to the wall of the charging gas collecting conduit 47 located transversely to the direction of movement of the enveloping carriage 10.

Figure 14:
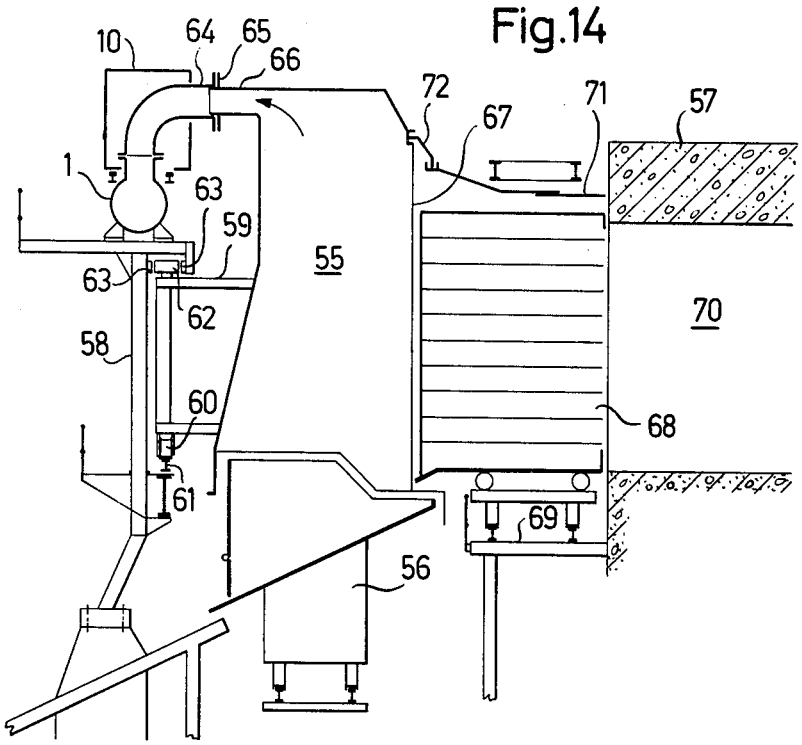
FIG. 14 shows the apparatus of the invention in connection with a hood on the coking side of a coke oven battery as cross-section of the battery.
Figure 15:
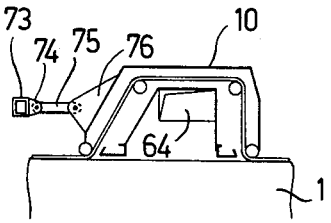
FIG. 15 is a vertical cross-section through the enveloping carriage of FIG. 16.
Figure 16:
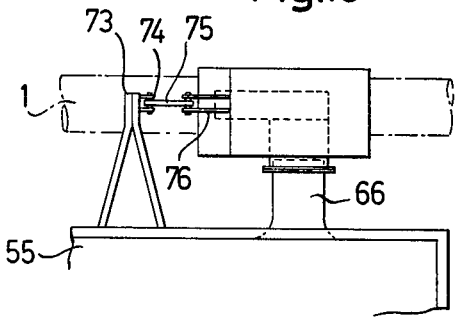
FIG. 16 is a plan view of the enveloping carriage.

FIGS. 14–16 show the device of the present invention in connection with a hood 55 overhanging a quenching car 56 and quided at its side opposite a coke oven battery 57 along a support 58 by means of a frame 59. This frame 59 is movably supported along its bottom side by wheels 60 in a track 61 attached to the support 58 and parallel to the coke oven battery. Guide wheels 62 rotatable about vertical axes are located at the top side of the frame 59, said wheels 62 being guided by a pair of guide tracks 63 extending parallel to the coke oven battery. The collecting main 1 is located on said support as is also the movable enveloping carriage 10, its connecting duct 64 being connected with a discharge duct 66 of the hood 55 by means of a connecting flange 65. The reference character 67 designates a junction between the hood and a coke guide 68 movable in familiar fashion along a so-called master gallery 69 of the coke oven battery and serving to push the hot coke from a coking chamber 70 into the quenching car 56. The coke guide 68 is also covered by means of a hood 71 joined to the hood 55 in an air-tight seal by means of a connecting piece 72.

A flexible connection between the hood 55 and the enveloping carriage 10 illustrated in FIGS. 15 and 16 consists of a fork 73 provided at its end with a forked attachment piece 74 linked to one front end of the enveloping carriage 10 through a forked attachment piece 76 by means of a strap 75. This permits dragging the enveloping carriage 10 along with the aid of the hood 55, said hood 55 either being coupled to the coke guide in known fashion for the purpose of such combined movement, or independently movable along the support 58 by means of a drive mechanism associated with the wheels 60 and not illustrated in detail.

Although the invention has been illustrated and described therein with reference to the preferred embodiments thereof, it is understood that the present disclosure is made only as an example and that it is in no way limited to the details of such embodiments and is capable of numerous modifications within the scope of the invention defined by the appended claims.

What is claimed is:

1. In an apparatus for removing hot gases from the vicinity of a coking oven battery comprising a gas-collecting arrangement mounted at the coking oven battery for movement in a path from one coking oven to another; means for conducting the hot gases collected in said gas-collecting arrangement to a location remote from the coking oven battery, including an elongated main duct stationarily mounted at the coking oven battery in substantial parallelism with said path and having an elongated opening extending longitudinally of said main duct and communicating with said gas-collecting arrangement at a portion thereof which is in registry with the latter, and a flexible belt covering the elongated opening, and said gas-collecting arrangement including roller means provided on the inside thereof for lifting the flexible belt to provide open communication between the gas-collecting arrangement and the main duct; the improvement comprising means for protecting said belt from deleterious influences of the hot gases entering said main duct through said portion of said opening and conducted longitudinally of said main duct toward said remote location, including a shielding device accommodated in said main duct extending across the interior of said main duct at least in a region juxtaposed with said portion of said opening to separate the hot gases in the collecting main from said belt.

2. The improvement as defined in claim 1, wherein said protecting means further includes a plurality of cooling tubes arranged between said shielding device and said belt and extending transversely of the elongation of said main duct and substantially parallel to said belt, said cooling tubes having blowing outlets oriented toward said belt and through which cooling air issues from said cooling tubes generally in the direction of flow of the hot gases toward said belt.

3. The improvement as defined in claim 1, wherein said gas-collecting arrangement includes a mobile gas-collecting housing operative for collecting the hot gases escaping from the respective coking oven at the discharge side thereof.

4. The improvement as defined in claim 1, wherein said gas-collecting arrangement includes a mobile gas-collecting housing operative for collecting the hot gases escaping from the respective coking oven at the filling side thereof.

5. The improvement as defined in claim 1, wherein said roller means include pressing rollers which press the belt against the collecting main and lifting rollers which lift the belt, said rollers being mounted so that as the gas-collecting arrangement moves along the main duct the just-lifted belt is at an acute angle with respect to a plane extending longitudinally of said main duct, and wherein said protecting means further includes at least one cooling pipe arranged at the location of the just-lifted belt having at least one opening directing a stream of cooling air against said belt at said location.

6. The improvement as defined in claim 1, wherein said shielding device includes a plurality of guide plates mounted in the interior of said main duct and extending across the same, said guide plates being substantially uniformly distributed over the entire length of said main duct.

7. The improvement as defined in claim 6, wherein the hot gases enter the interior of said main duct through said portion of said opening in a predetermined direction; and wherein the longitudinal dimension of a projection of each of said guide plates in said direction into a plane extending longitudinally of and across said main duct at least equals one-half of the distance between two adjacent guide plates.

8. The improvement as defined in claim 6, wherein said guide plates are stationarily mounted in said interior.

9. The improvement as defined in claim 6, wherein each of said guide plates has a concave surface for guiding the hot gases.

10. The improvement as defined in claim 6, wherein said guide plates are hollow; and further comprising ventillation means communicating with the interior hollows of said guide plates.

11. The improvement as defined in claim 6, wherein said shielding device further includes pivot means for mounting said guide plates in said main duct for pivoting about parallel axes extending across said main duct.

12. The improvement as defined in claim 11, wherein said pivot means of each of said guide plates includes a shaft having an end portion which extends to the exterior of said main duct; and wherein said shielding means further includes means for adjusting the positions of said guide plates about said axes, including a plurality of levers each mounted on one of said end portions for joint pivoting with said shaft, and actuating means operative for contacting and angularly displacing the respective levers for rotating the respective shafts of said guide plates.

13. The improvement as defined in claim 12, wherein said gas-collecting arrangement includes an enveloping carriage; and wherein said actuating means includes an actuating device including a crosstie and mounted on said enveloping carriage for displacement between an extended position in which said crosstie engages some of said levers and a retracted position in which said crosstie is disengaged from said levers, and means for displacing said actuating device between said extended and retracted positions thereof.

* * * * *